US007703619B2

(12) United States Patent
Van Puijenbroek

(10) Patent No.: US 7,703,619 B2
(45) Date of Patent: Apr. 27, 2010

(54) PACKAGE WITH PEEL-OFF CLOSURE

(75) Inventor: Alexander Josephus Maricus Van Puijenbroek, ZP-Den Bosch (NL)

(73) Assignee: H.J. Heinz Holding B.V., BC Elst (NL)

( * ) Notice: Subject to any disclaimer, the term of this patent is extended or adjusted under 35 U.S.C. 154(b) by 720 days.

(21) Appl. No.: 10/542,330

(22) PCT Filed: Jan. 8, 2004

(86) PCT No.: PCT/NL2004/000008

§ 371 (c)(1),
(2), (4) Date: May 12, 2006

(87) PCT Pub. No.: WO2004/063048

PCT Pub. Date: Jul. 29, 2004

(65) Prior Publication Data

US 2006/0278562 A1 Dec. 14, 2006

(30) Foreign Application Priority Data

Jan. 13, 2003 (NL) ..... 1022368

(51) Int. Cl.
*B65D 17/34* (2006.01)
*B65D 17/28* (2006.01)

(52) U.S. Cl. ..... 220/4.21; 220/266; 220/270; 220/359.2

(58) Field of Classification Search ..... 220/4.21, 220/4.24, 266, 270, 359.1, 359.2, 359.3; 222/107, 212, 491, 494; 206/532, 813
See application file for complete search history.

(56) References Cited

U.S. PATENT DOCUMENTS 4,155,454 A * 5/1979 Ryden ..... 206/532

(Continued)

FOREIGN PATENT DOCUMENTS

FR 2 801 570 A1 6/2001

(Continued)

OTHER PUBLICATIONS

JP 01-111680 + English Abstract.

(Continued)

*Primary Examiner*—Anthony Stashick
*Assistant Examiner*—Niki M Eloshway
(74) *Attorney, Agent, or Firm*—Buchanan Ingersoll & Rooney PC

(57) ABSTRACT

The invention relates to a package suitable for containing a perishable product, comprising a first shell element provided with an upright circumferential edge and a central portion for accommodating said perishable product, as well as a closure element provided with a circumferential edge which closure element is placed with its circumferential edge on the upright circumferential edge of said first shell element in an adhering and closing manner and wherein said closure element is provided at its circumferential edge with a protruding lip, which lip does not adhere to the circumferential edge of said first shell element, for the purpose of peeling off said closure element from said first element. Near said lip the two circumferential edges are provided with a closed channel being in communication with said central portion, and wherein at least one of said circumferential edges is provided with a fracture line extending substantially perpendicularly to said channel.

7 Claims, 1 Drawing Sheet

U.S. PATENT DOCUMENTS

Figure 1A:
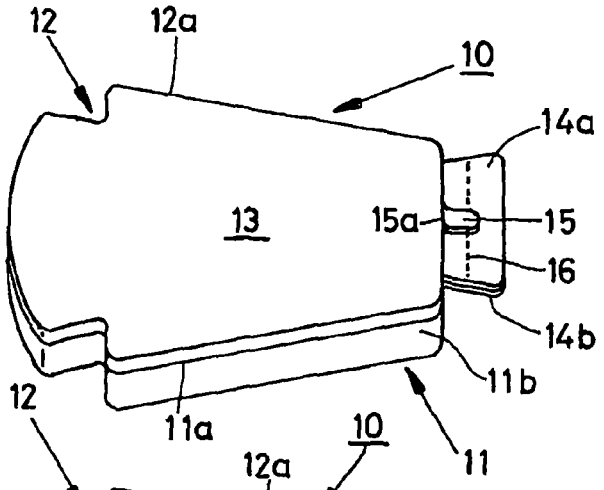

| | | | | | |
|---|---|---|---|---|---|
| 4,537,312 | A | * | 8/1985 | Intini | 206/531 |
| 4,673,085 | A | * | 6/1987 | Badouard et al. | 220/266 |
| 4,693,391 | A | * | 9/1987 | Roth | 220/359.2 |
| 4,717,046 | A | | 1/1988 | Brogli | |
| 4,765,463 | A | * | 8/1988 | Chanel | 206/213.1 |
| 4,921,137 | A | | 5/1990 | Hiejenga | |
| 4,946,038 | A | * | 8/1990 | Eaton | 206/528 |
| 5,156,329 | A | * | 10/1992 | Farrell | 229/125.35 |
| 5,235,149 | A | * | 8/1993 | Boehrer | 219/734 |
| 5,529,224 | A | | 6/1996 | Chan et al. | |
| 5,613,517 | A | * | 3/1997 | Handler | 137/512.4 |
| 5,758,774 | A | * | 6/1998 | Leblong | 206/531 |
| 5,839,609 | A | * | 11/1998 | Zakensberg | 222/107 |
| 6,085,942 | A | * | 7/2000 | Redmond | 222/107 |
| 6,199,698 | B1 | * | 3/2001 | Hetrick et al. | 206/532 |
| 6,648,140 | B2 | * | 11/2003 | Petricca | 206/356 |
| 7,004,322 | B1 | * | 2/2006 | Bartoli | 206/484 |
| RE39,520 | E | * | 3/2007 | Hess et al. | 222/92 |
| 2002/0117500 | A1 | * | 8/2002 | Buisson et al. | 220/258.2 |
| 2002/0148855 | A1 | * | 10/2002 | Sokolsky et al. | 222/107 |
| 2003/0015605 | A1 | * | 1/2003 | Garcia et al. | 239/327 |

FOREIGN PATENT DOCUMENTS

| | | |
|---|---|---|
| JP | 52-38551 | 3/1977 |
| JP | 61-59558 | 3/1986 |
| JP | 61-93470 | 5/1986 |
| JP | 07-035172 | 4/1995 |
| WO | WO 97/28054 A | 8/1997 |
| WO | WO/02/070352 | 9/2002 |

OTHER PUBLICATIONS

English translation of Japanese examination report dated Aug. 12, 2008.

* cited by examiner

PACKAGE WITH PEEL-OFF CLOSURE

CROSS-REFERENCE TO RELATED APPLICATION

This application is a 371 application of PCT Application No. PCT/NL2004/000008, filed Jan. 8, 2004, now WO 2004/063048 A1 (published in English) which designates the United States of America and which claims priority from Dutch Application No. 1022368, filed Jan. 13, 2003. The disclosure of both applications is incorporated herein in their entireties.

The invention relates to a package suitable for containing a perishable product, comprising a first shell element provided with an upright circumferential edge and a central portion for accommodating said perishable product, as well as a closure element provided with a circumferential edge, which closure element is placed with its circumferential edge on the upright circumferential edge of said first shell element in an adhering and closing manner and wherein said closure element is provided at its circumferential edge with a protruding lip, which lip does not adhere to the circumferential edge of said first shell element, for the purpose of peeling off said closure element from said first element.

Such a package is generally known, it is used for packaging products or substances, more in particular for perishable products or substances, such as foodstuffs. More specifically, such packages are used for packaging perishable foodstuffs in the form of a liquid or a gel-like substance, such as milk or yoghurt products, sweet products such as honey, jam, peanut butter, chocolate spread etc etc. Such packages are gaining in popularity these days, and consequently they are increasingly used as one-person packages.

One drawback of the one-person package that is currently known is the fact that the product present in the package must be directly consumed once the package has been opened or the closure element has been peeled off. The fact is that the package as referred to in the introduction cannot be considered to be a reclosable package.

The object of the invention is to provide a more versatile package as referred to in the introduction, which new package is more multifunctional and which can furthermore be used in various ways by the user.

According to the invention, the package is to that end characterized in that near said lip the two circumferential edges are provided with a closed channel being in communication with said central portion, and wherein at least one of said circumferential edges is provided with a fracture line extending substantially perpendicularly to said channel. An additional use is created with this package according to the invention, viz. metering the product present in the central portion of the package via the channel. The channel functions as a metering opening. The metering channel is opened by tearing off the foil material along the fracture line, and a package is realised which, in addition to the serving function (viz. the peeling off of the closure element from the first shell element) also has a metering function.

In a special embodiment, the package according to the invention is characterized in that at least one of the circumferential edges is provided with at least one notch near the fracture line. The circumferential edge may be provided with a notch on either side of the fracture line, in which case the notch terminates at a position close to the channel. With this embodiment of a package according to the invention, which features a notch near the fracture line and the channel, a simple turning movement will cause the foil material to be locally torn and the channel to be opened, thus creating a package provided with a metering opening.

The two different functions render the package according to the invention more versatile in use.

In another embodiment, the closure element is embodied as a flat element lying in the plane of the circumferential edge.

In another embodiment, the closure element is embodied as a second element having an upright circumferential edge and a central portion. Preferably, said first and said second shell element are identical. In yet another advantageous embodiment of the package according to the invention, the closure element and the first shell element are made of the same material. Said parts may also be made of different materials, however.

Figure 1B:
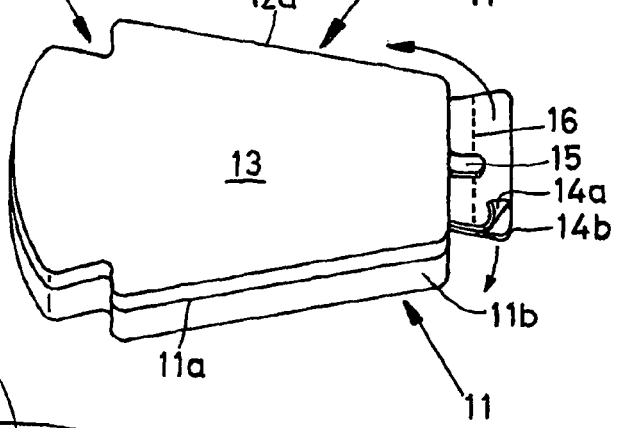
Figure 2A:
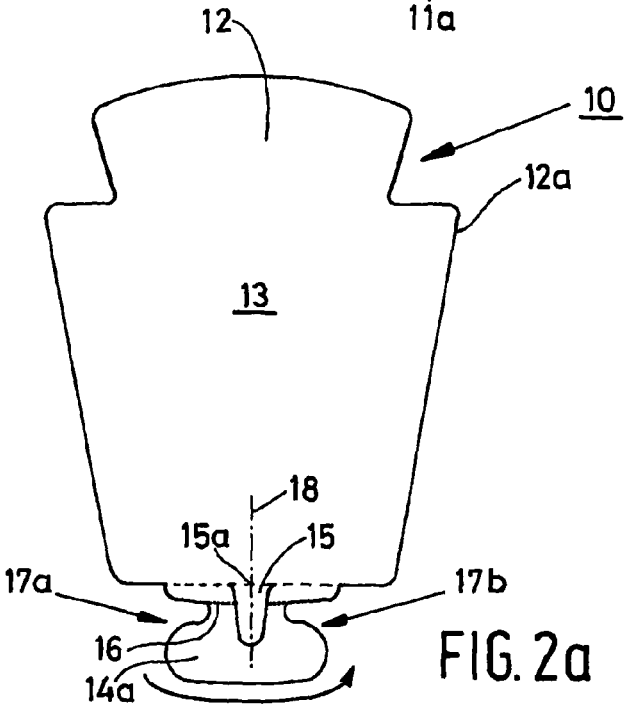

The invention will now be explained in more detail with reference to the drawing, in which:

FIGS. 1*a*-1*b* show a first embodiment of a package according to the present invention; and FIG. 2 shows another embodiment of a package according to the present invention.

The package 10 that is shown in FIGS. 1*a* and 1*b* is made up of a first shell element 11 provided with upright edges 11*b*, which forms a circumferential edge 11*a*. The package 10 is furthermore provided with a closure element 12, which is likewise provided with a circumferential edge 12*a* which, on account of its adhesive property, can be removably yet sealingly placed on the circumferential edge 11*a*. As a result, the central portion 13 thus formed by the first shell element 11 and the product contained therein can be sealed.

The package according to the invention is in particular suitable for containing a certain amount of a foodstuff, such as milk or yoghurt products, but also liquids or suspension-like foodstuffs such as mayonnaise, ketchup, jam, peanut butter, etc etc. However, the package according to the invention is also suitable for containing a certain amount of a body care product, such as soap, shampoo, hair conditioner, cosmetics, etc etc.

The closure element 12 is provided, in a manner which is known per se, with a projecting lip 14*a* near the circumferential edge 12*a*, which a user can pull up with his hand in a known manner, so that the closure element 12 can be peeled off the circumferential edge 11*a* of the upright edge 11*b* of the first shell element 11 by its circumferential edge 12*a*. In this known manner the package 10 is opened in its entirety and the amount of product contained in the central portion 13 becomes available for being used or consumed by the user.

One problem of this currently known package, which may be embodied as a cup for coffee cream, is the fact that the amount of product contained in the package 10 must be consumed directly and cannot be stored for a prolonged period of time once the package 10 has been opened. Consequently, there is a need for a package which on the one hand provides a possibility of opening the package completely, as is the case with the package that is presently known, but which on the other hand also provides a possibility of storing the products contained in the package 10 for some time once the package has been opened, without the risk of spillage or rapid decay.

The embodiment of the package 10 that is disclosed in FIGS. 1*a* and 1*b* is to that end characterized in that the package 10 is provided with a channel 15 near the circumferential edge 11*a*-12*b*, which channel 15 is formed by the two lips 14*a* and 14*b* of the closure element 12 and the first shell element 11, respectively, which are arranged one on top of the other. The channel 15 that is thus formed by the lips 14*a*-14*b* arranged one on top of the other is fully enclosed by the material of the lips 14*a*-14*b* and opens into the central portion 13 in which the liquid or suspension-like product is contained near the position that is indicated by numeral 15*a* in the Figure. Furthermore, the lip 14*a*, and more in particular also the lip 14*b* of the first shell element 11 is provided with a fracture line 16, which fracture line 16 extends perpendicularly to the channel 15. The fracture line 16 may be formed by making a small cut in the material of the lip 14*a*.

Thus it is possible for the user on the one hand to pull the lip 14*a* up and peel the closure element 12 off the circumferential edge 11*a* of the first shell element 11, but in addition it is possible to bend the lip 14*a* (and possibly the lip 14*b*) back a few times along the fracture line 16, until the lip 14*a* (and 14*b*) breaks off due to material fatigue, so that the channel 15 is opened and an outflow opening is thus formed.

The user can thus meter the product contained in the central portion (a foodstuff or a cosmetic product) via the outflow opening formed by the channel (which is open now) by pressing on the first shell element 11 and the closure element 12.

The present package 10 is in particular very suitable for packaging mayonnaise or ketchup products, for example, and the package is opened by peeling off the closure element 12, thus forming a fully open package 10, or a closed package 10 having a small metering opening 15 is formed by breaking off the lip 14*a* (and possibly the lip 14*b*).

In FIG. 2 another embodiment of the present invention is shown, in which like parts are indicated by identical numerals.

As in FIG. 1, both the first shell element and the closure element 12 are provided with overlapping lips 14*a*-14*b*, which form a channel 15, which channel opens into the central portion 13 of the package 10 at the position indicated at 15*a*. Both the lip 14*a* of the closure element 12 and the lip 14*b* of the first shell element 11 are provided with a fracture line 16 extending perpendicularly to the channel 15 in this embodiment. Furthermore, the two lips 14*a*-14*b* are each provided with a notch 17*a* and 17*b*, respectively, which notches terminate close to the channel 15.

The user can now turn or break off the lips 14*a*-14*b* along the fracture line 16 by turning or twisting the two lips 14*a*-14*b* about the elongate axis 18 formed by the channel 15, thus creating an open aperture 15 that functions as a metering opening.

This embodiment, too, provides a multifunctional package 10 according to the invention, which, in addition to the known possibility of being opened by peeling off the shell element 12, also provides a metering function.

Figure 2B:
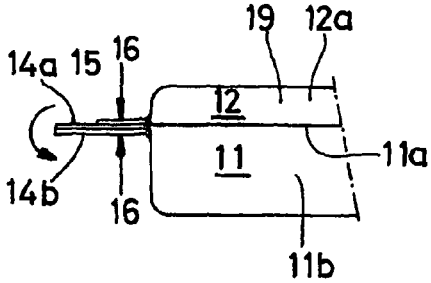

In one possible embodiment, the closure element 12 may be embodied as a flat element lying in the plane of the circumferential edge 12*a*, whilst in another embodiment the closure element 12 may be embodied as a second shell element having an upright circumferential edge 12*a* as well as a central portion 19 as shown in FIG. 2*b*. Said first and said second shell element 11 and 12 may be identical. Although it is possible to use different materials for the first shell element 11 and the closure element 12, the two elements are preferably made of the same material. This results in a strong as well as uniform package 10, which in addition provides a certain degree of rigidity when used for metering the product contained in the package 10, the more so because the package 10 can be squeezed empty by the user when metering the product.

The invention claimed is:

1. A package suitable for containing a perishable product, comprising a first shell element provided with a generally planar bottom surface and an upright circumferential edge extending upwardly from the generally planar bottom surface and a central portion for accommodating said perishable product, as well as a closure element provided with a circumferential edge, which closure element is placed with its circumferential edge on the upright circumferential edge of said first shell element in an adhering and closing manner and wherein at least a portion of said closure element is provided at its circumferential edge with a protruding lip, which lip does not adhere to the circumferential edge of said first shell element, for the purpose of peeling off said closure element from said first element to expose the central portion, characterized in that near said lip the two circumferential edges are provided with a closed channel being in communication with said central portion, and wherein at least one of said circumferential edges is provided with a fracture line extending substantially perpendicularly to said channel.

2. A package according to claim 1, characterized in that at least one of the circumferential edges is provided with at least one notch near said fracture line.

3. A package according to claim 2, characterized in that said circumferential edge is provided with a notch on either side of said fracture line.

4. A package according to claim 2, characterized in that said notch terminates at a point close to said channel.

5. A package according to claim 1, characterized in that said closure element and said first element are made of the same material.

6. A package suitable for containing a perishable product, comprising a first shell element provided with a generally planar bottom surface and an upright circumferential edge extending upwardly from the generally planar bottom surface and a central portion for accommodating said perishable product, as well as a closure element provided with a circumferential edge, which closure element is placed with its circumferential edge on the upright circumferential edge of said first shell element in an adhering and closing manner and wherein at least a portion of said closure element is provided at its circumferential edge with a protruding lip, which lip does not adhere to the circumferential edge of said first shell element, for the purpose of peeling off said closure element from said first element to expose the central portion, characterized in that near said lip the two circumferential edges are provided with a closed channel being in communication with said central portion, and wherein at least one of said circumferential edges is provided with a fracture line extending substantially perpendicularly to said channel;

wherein at least one of the circumferential edges is provided with at least one notch near said fracture line; said circumferential edge is provided with a notch on either side of said fracture line; said notch terminates at a point close to said channel; the closure element comprises a flat element lying in the plane of the circumferential edge; and said closure element and said first element are made of the same material.

7. A package suitable for containing a perishable product, comprising a first shell element provided with a generally planar bottom surface and an upright circumferential edge extending upwardly from the generally planar bottom surface and a central portion for accommodating said perishable product, as well as a closure element provided with a circumferential edge, which closure element is placed with its circumferential edge on the upright circumferential edge of said first shell element in an adhering and closing manner and wherein at least a portion of said closure element is provided at its circumferential edge with a protruding lip, which lip does not adhere to the circumferential edge of said first shell element, for the purpose of peeling off said closure element from said first element to expose the central portion, characterized in that near said lip the two circumferential edges are provided with a closed channel being in communication with said central portion, and wherein at least one of said circumferential edges is provided with a fracture line extending substantially perpendicularly to said channel;

wherein at least one of the circumferential edges is provided with at least one notch near said fracture line; said circumferential edge is provided with a notch on either side of said fracture line; said notch terminates at a point close to said channel; the closure element comprises a second element having an upright circumferential edge and a central portion; and said closure element and said first element are made of the same material.

* * * * *